US011430370B2

(12) United States Patent
Hong et al.

(10) Patent No.: US 11,430,370 B2
(45) Date of Patent: Aug. 30, 2022

(54) DISPLAY DEVICE AND METHOD FOR IMAGE PROCESSING THEREOF

(71) Applicant: LG ELECTRONICS INC., Seoul (KR)

(72) Inventors: Sungmin Hong, Seoul (KR); Changhyun Lee, Seoul (KR); Kwangyeon Rhee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 56 days.

(21) Appl. No.: 16/970,939

(22) PCT Filed: Mar. 6, 2018

(86) PCT No.: PCT/KR2018/002668
§ 371 (c)(1),
(2) Date: Aug. 18, 2020

(87) PCT Pub. No.: WO2019/164045
PCT Pub. Date: Aug. 29, 2019

(65) Prior Publication Data

US 2021/0366359 A1 Nov. 25, 2021

(30) Foreign Application Priority Data

Feb. 26, 2018 (KR) ..... 10-2018-0022824

(51) Int. Cl.
*G09G 3/20* (2006.01)
*G09G 3/32* (2016.01)

(52) U.S. Cl.
CPC ..... *G09G 3/2096* (2013.01); *G09G 3/32* (2013.01); *G09G 2320/0233* (2013.01);
(Continued)

(58) Field of Classification Search
CPC ..... G09G 3/2096; G09G 3/32; G09G 2320/0233; G09G 2320/0257; G09G 2320/046; G09G 2340/04
See application file for complete search history.

(56) References Cited

U.S. PATENT DOCUMENTS

2007/0019007 A1 1/2007 Jung
2016/0063677 A1* 3/2016 Deamo ..... G06T 3/4092 382/199
2017/0287109 A1* 10/2017 Tasfi ..... G06T 3/4046

FOREIGN PATENT DOCUMENTS

KR 1020050068405 7/2005
KR 20120106558 9/2012
(Continued)

OTHER PUBLICATIONS

PCT International Application No. PCT/KR2018/002668, International Search Report dated Nov. 21, 2018, 3 pages.
(Continued)

*Primary Examiner* — Xin Sheng
(74) *Attorney, Agent, or Firm* — Lee, Hong, Degerman, Kang & Waimey PC

(57) ABSTRACT

The present invention relates to a display device and a method for image processing thereof, in which an input image is enlarged and a part of the enlarged image is selected as an image to be displayed on the screen of a display panel, and it is possible to thereby prevent screen burn-in and to prevent a phenomenon in which pixel data is not present and thus a pixel appears black when an image is moved on the screen.

11 Claims, 10 Drawing Sheets

(52) U.S. Cl.
CPC ..... *G09G 2320/0257* (2013.01); *G09G 2320/046* (2013.01); *G09G 2340/04* (2013.01)

(56) References Cited

FOREIGN PATENT DOCUMENTS

| | | |
|---|---|---|
| KR | 20150130592 | 11/2015 |
| KR | 20160032312 | 3/2016 |

OTHER PUBLICATIONS

Korean Intellectual Property Office Application No. 10-2018-0022824, Office Action dated Jun. 24, 2022, 4 pages.

* cited by examiner

【Figure 1】
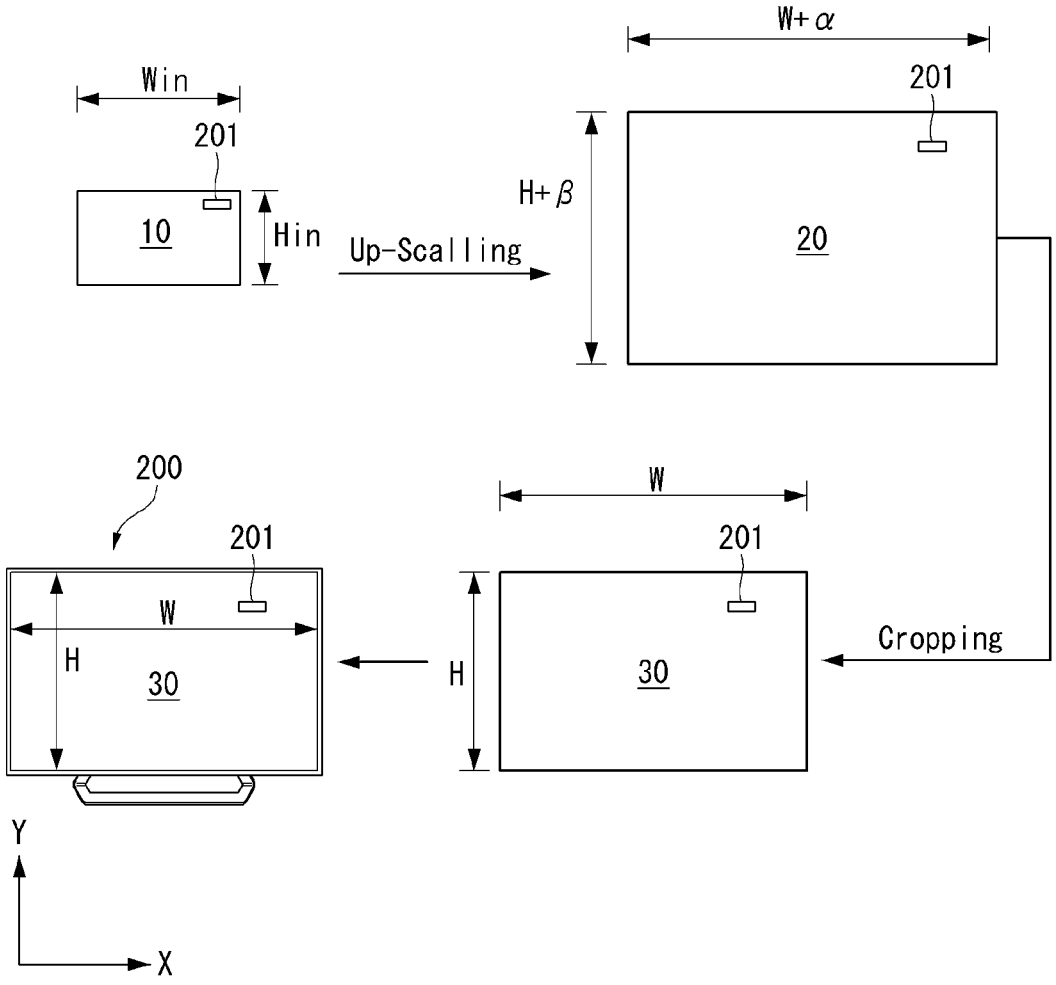

【Figure 2】
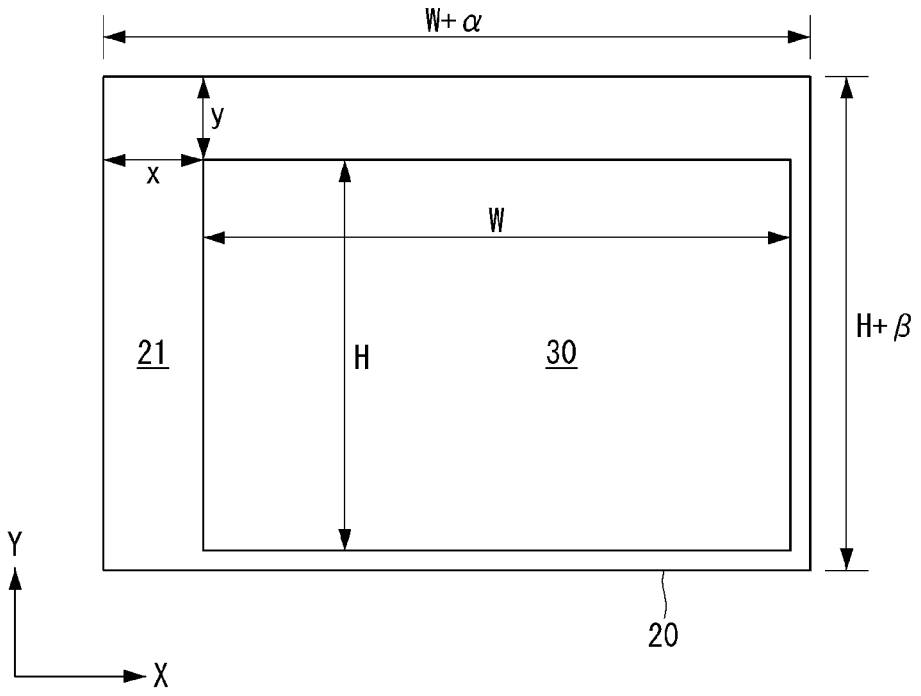

【Figure 3】
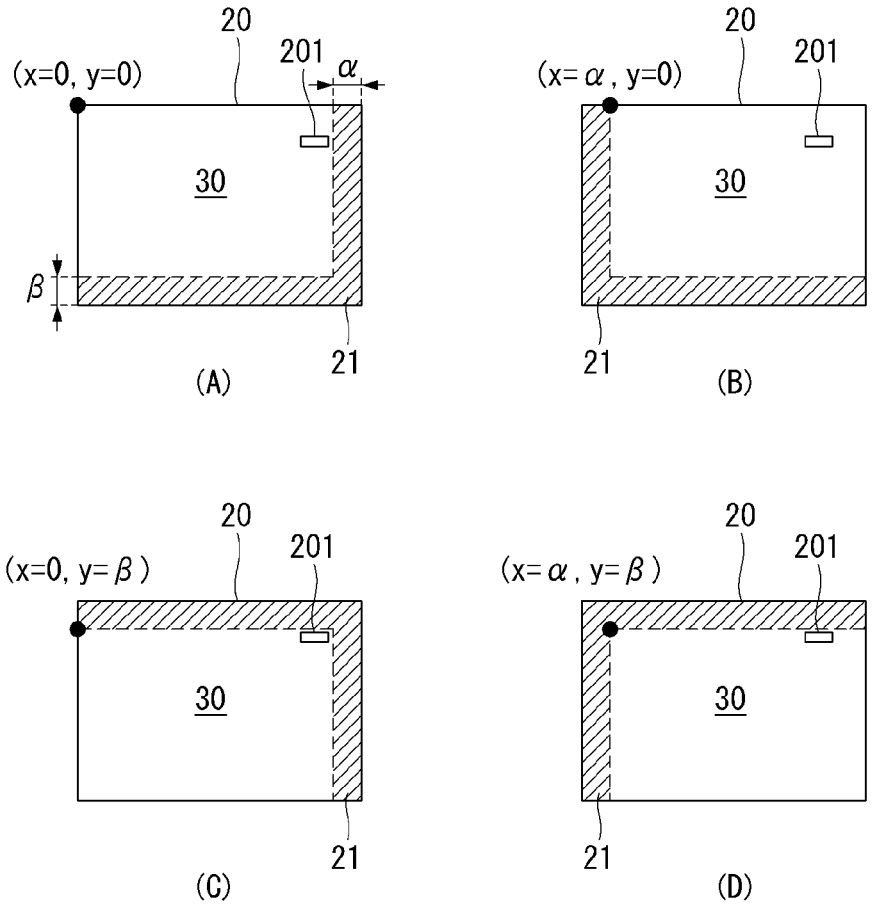

【Figure 4】
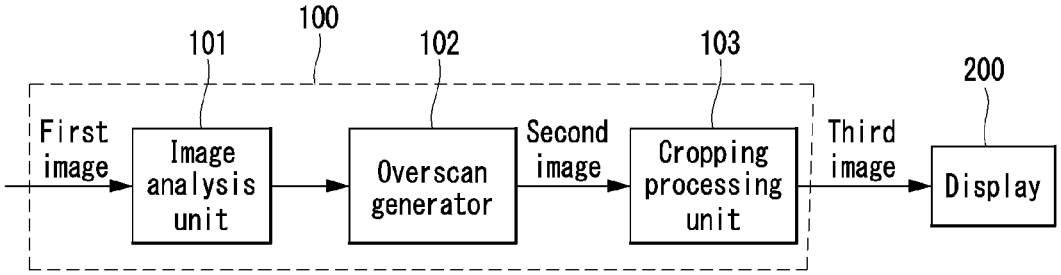
【Figure 5】
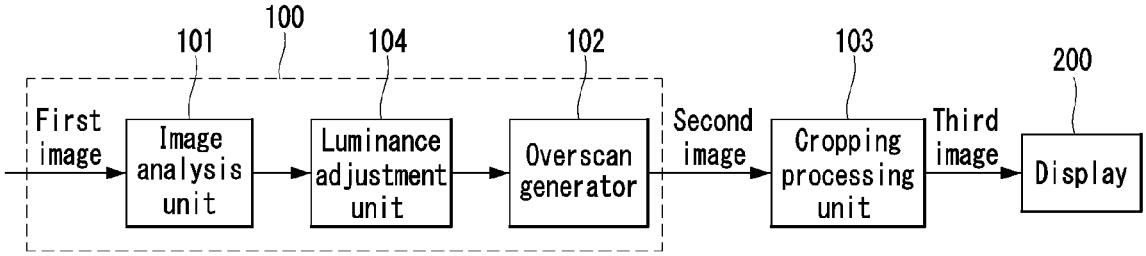

【Figure 6】
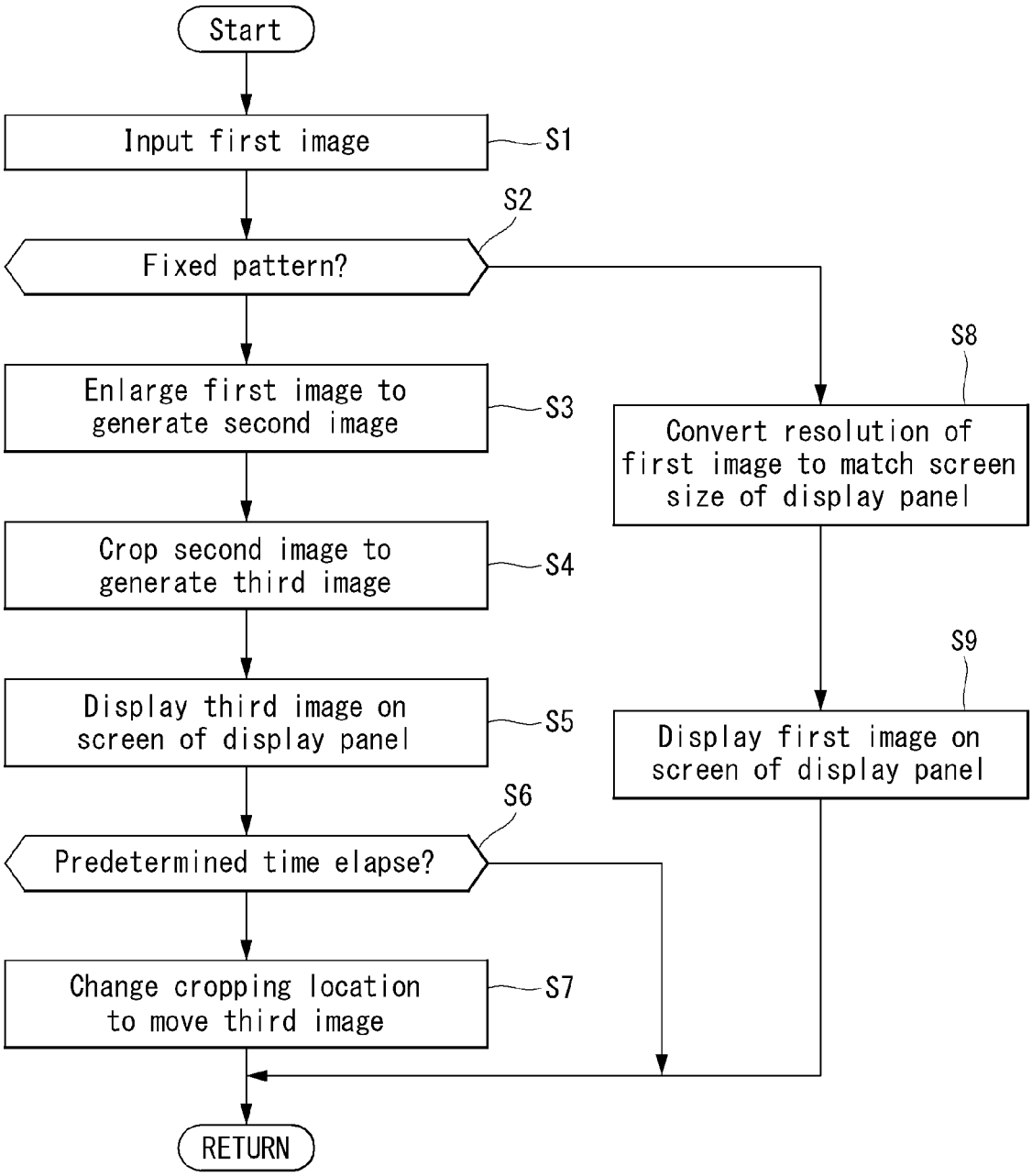

【Figure 7】
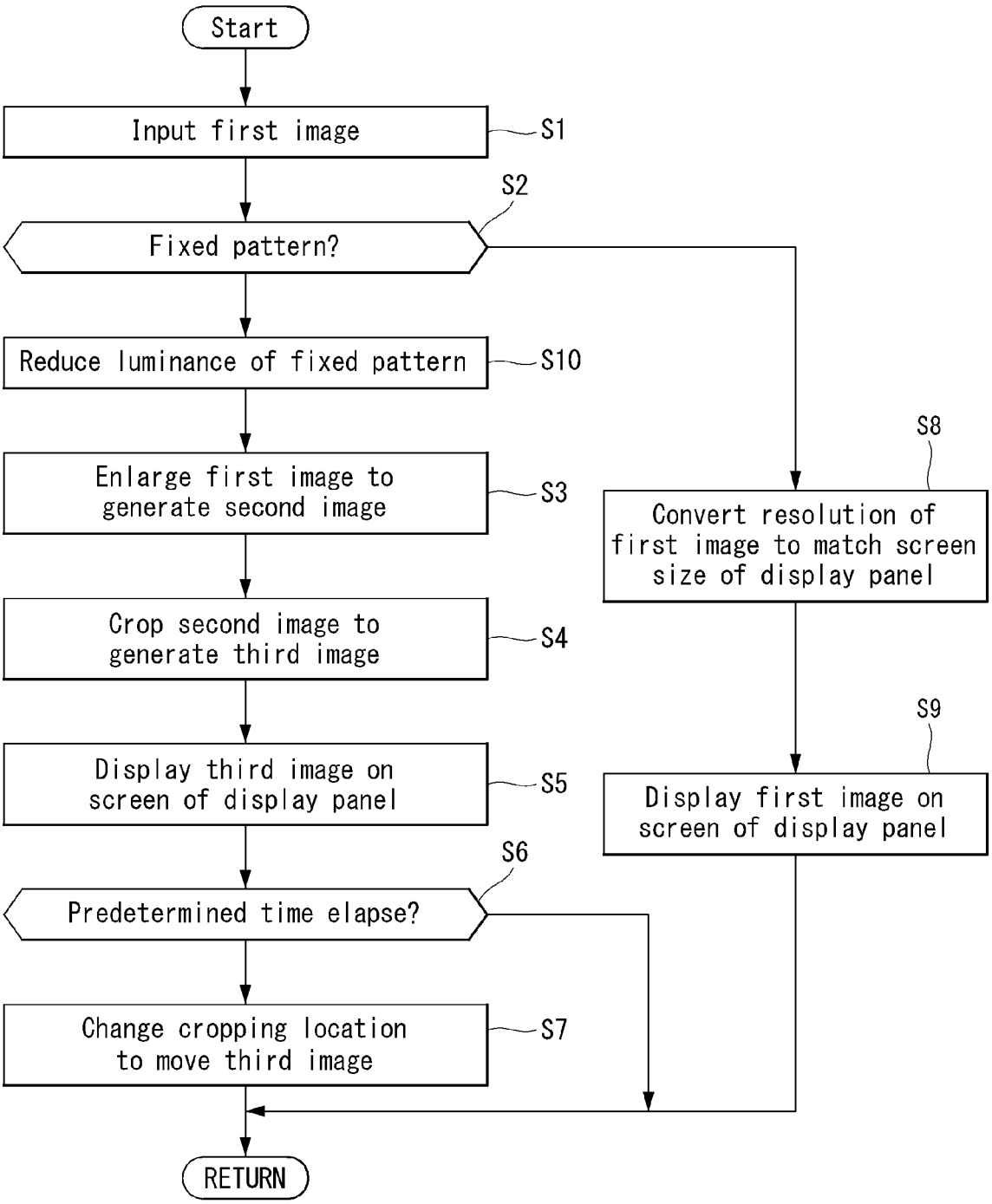

【Figure 8】
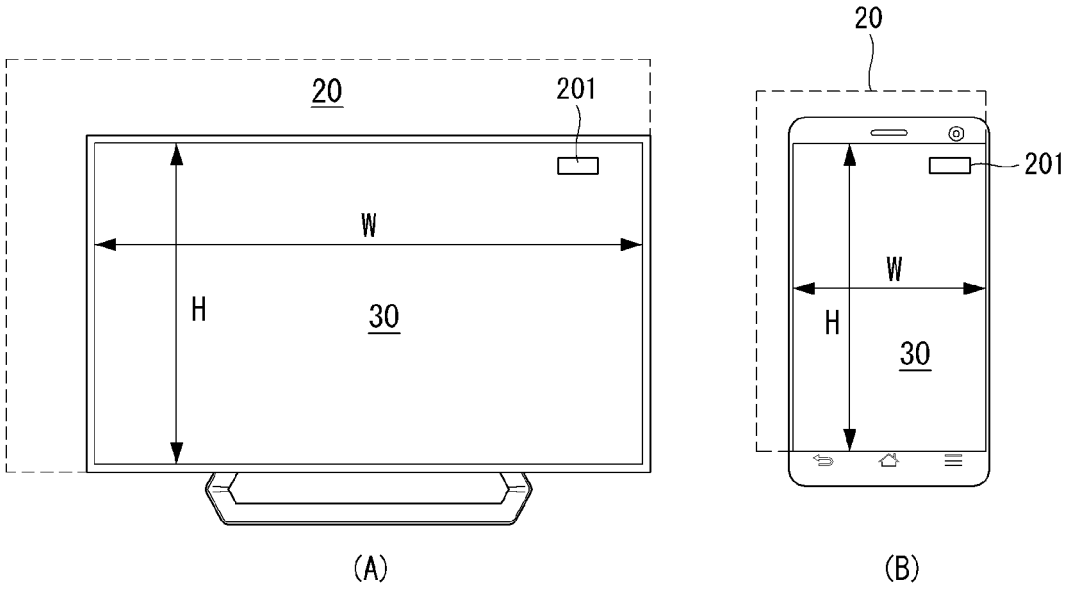

【Figure 9】
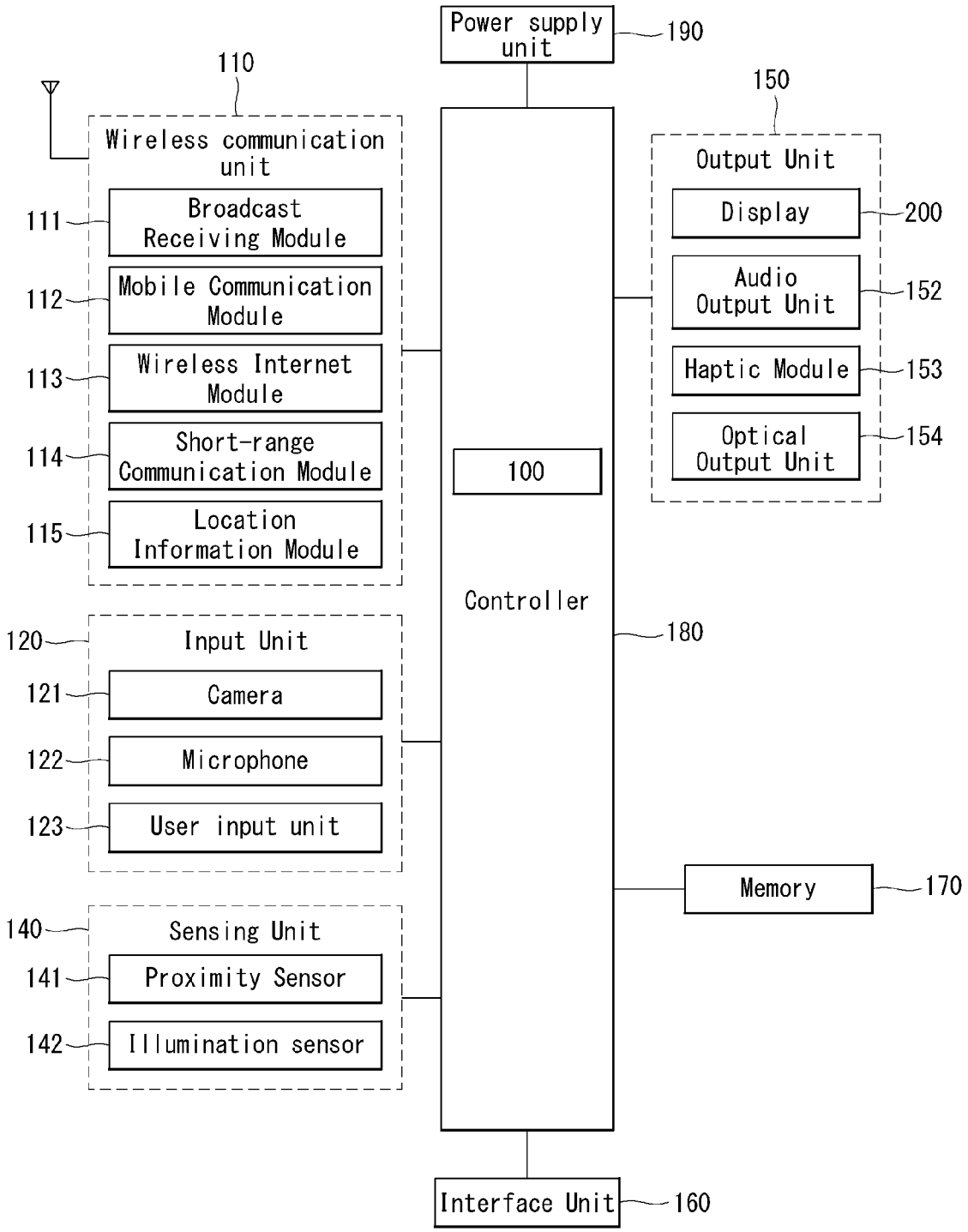

【Figure 10】
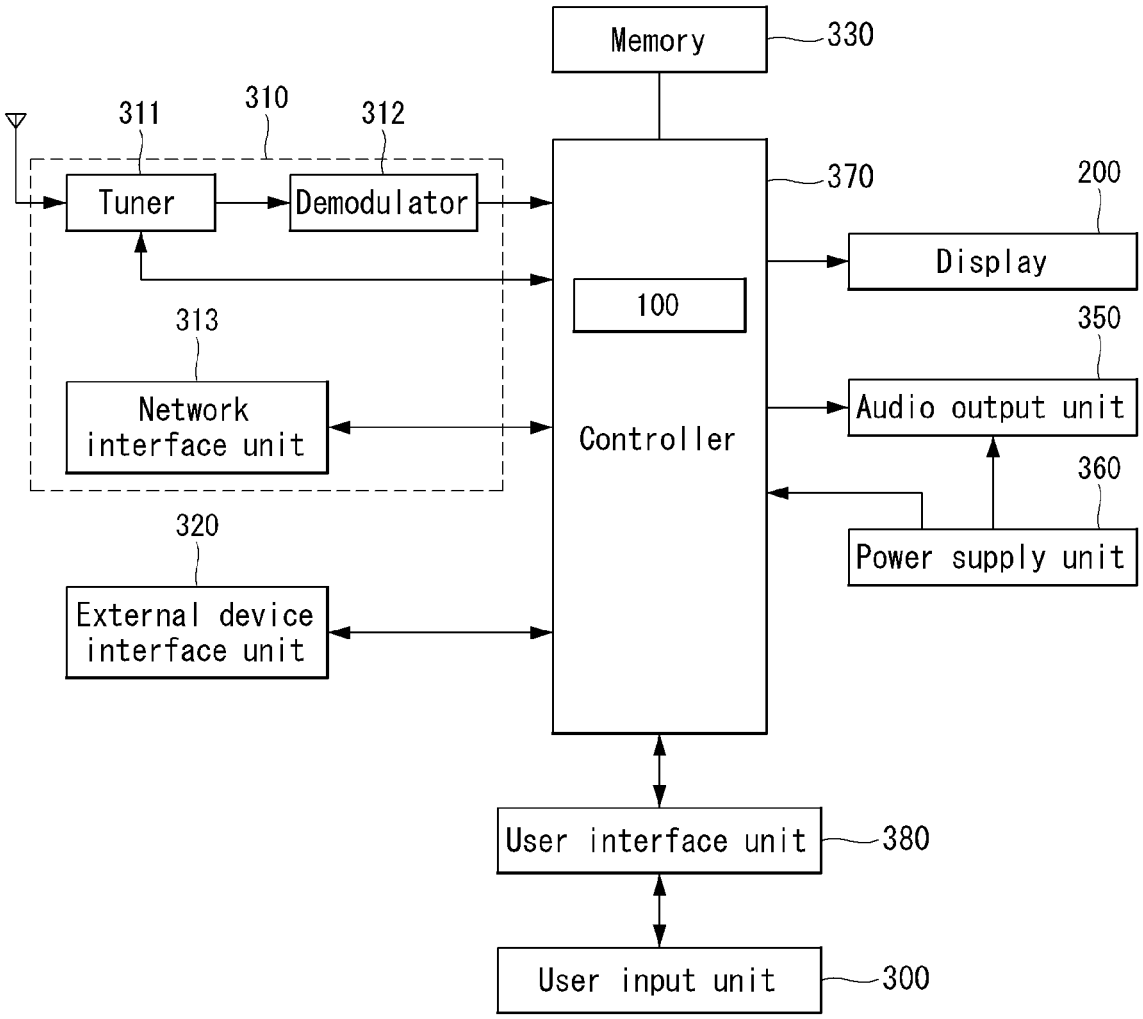

【Figure 11】
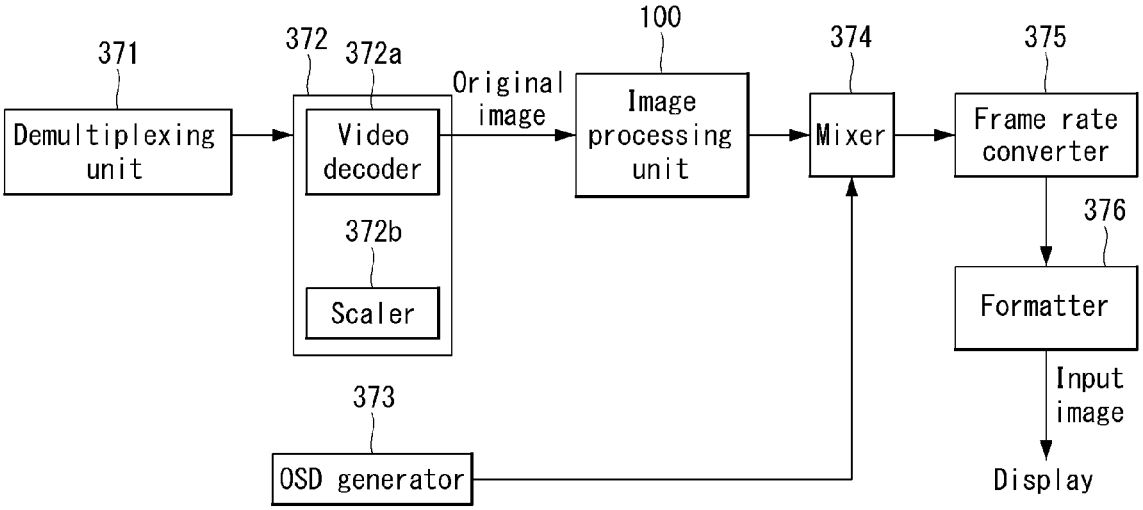

DISPLAY DEVICE AND METHOD FOR IMAGE PROCESSING THEREOF

CROSS-REFERENCE TO RELATED APPLICATIONS

This application is the National Stage filing under 35 U.S.C. 371 of International Application No. PCT/KR2018/002668, filed on Mar. 6, 2018, which claims the benefit of earlier filing date and right of priority to Korean Application No. 10-2018-0022824, filed on Feb. 26, 2018, the contents of which are all hereby incorporated by reference herein in their entirety.

TECHNICAL FIELD

The present disclosure relates to a display device and an image processing method thereof capable of preventing a burn-in phenomenon due to a fixed pattern displayed on a screen of a display panel.

BACKGROUND ART

Examples of flat panel display include a liquid crystal display (LCD), a plasma display panel (PDP), an organic light emitting diode (OLED) display, and the like.

In these display devices, when data values of specific pixels are maintained for a long time, image retention may occur. In particular, if pixel values of specific pixels in the OLED display are maintained for a long time, the pixels are degraded, resulting in a burn-in phenomenon. The burn-in phenomenon indicates non-restoring image retention in which OLEDs of pixels that display a fixed pattern (e.g., text, image, etc.) for a long time in the OLED display are degraded, and the previous fixed pattern is visible even if another image is displayed on the pixels. Thus, the burn-in phenomenon makes image retention visible even in a normal image using the entire screen.

DISCLOSURE

Technical Problem

An organic light emitting diode (OLED) display may implement an orbit algorithm to prevent image retention resulting from a burn-in phenomenon. The orbit algorithm is configured such that an image including a fixed pattern moves left and right and up and down on a screen of a display panel every specific time, for example, every several minutes. The orbit algorithm disperses degradation of pixels and alleviates the image retention by periodically moving a location of the fixed pattern. However, this method has a side effect in that edge pixels look black, and thus a bezel seems to increase because an image with the same size as the screen size of the display panel moves. This is because there is no pixel data in pixels at an edge of the screen outside an image when the image moves on the screen of the display panel. Data of a predetermined black gray level is applied to pixels not having pixel data. Thus, in the related art orbit algorithm, when an image moves along a predetermined direction on the screen, a portion, that is processed at a black gray level because there is no pixel data, is visible in the opposite direction of a movement direction of the image.

The present disclosure provides a display device and an image processing method thereof capable of preventing a burn-in phenomenon and preventing a phenomenon in which a dark portion is enlarged at an edge of the screen.

Technical Solution

In one aspect, there is provided a display device comprising an image processing unit configured to generate a second image by enlarging a first image and generate a third image by selecting a portion of the second image; and a display panel configured to display the third image received from the image processing unit.

In another aspect, there is provided an image processing method of a display device comprising enlarging a first image to generate a second image; selecting a portion of the second image to generate a third image; and displaying the image on a screen of a display panel.

Advantageous Effects

The present disclosure moves a location of a fixed pattern displayed on a screen of a display panel by enlarging an input image, selecting a cropping area in the enlarged image as an image to be displayed on the screen of the display panel, and varying a location of the cropping area when a predetermined time elapses. Thus, the present disclosure can prevent a burn-in phenomenon due to the fixed pattern displayed on the screen and prevent a phenomenon in which a portion, that appears black because there is no pixel data, is visible when an image moves on the screen.

DESCRIPTION OF DRAWINGS

FIG. 1 schematically illustrates an image processing process according to an embodiment of the present disclosure.

FIG. 2 illustrates a second image including an overscan area and a third image selected in a cropping process.

FIG. 3 illustrates an example of varying a location of a third area displayed on a display panel in a second image by varying a location of a cropping area.

FIG. 4 is a block diagram illustrating an image processing unit according to a first embodiment of the present disclosure.

FIG. 5 is a block diagram illustrating a display device according to a second embodiment of the present disclosure.

FIGS. 6 and 7 are flow charts illustrating an image processing method according to an embodiment of the present disclosure.

FIG. 8 illustrates various examples of a display device.

FIG. 9 is a block diagram schematically illustrating an example of a mobile terminal.

FIGS. 10 and 11 are block diagrams illustrating an example of a stationary display device.

BEST MODE

Mode for Invention

Reference will now be made in detail to embodiments of the disclosure, examples of which are illustrated in the accompanying drawings. Wherever possible, the same reference numbers will be used throughout the drawings to refer to the same or like parts. In general, a suffix such as "module" and "unit" may be used to refer to elements or components. Use of such a suffix herein is merely intended to facilitate description of the present disclosure, and the suffix itself is not intended to give any special meaning or function. It will be noted that a detailed description of known arts will be omitted if it is determined that the detailed description of the known arts can obscure the embodiments of the disclosure. The accompanying drawings are used to help easily understand various technical features and it should be understood that embodiments presented herein are not limited by the accompanying drawings. As such, the present disclosure should be construed to extend to any alterations, equivalents and substitutes in addition to those which are particularly set out in the accompanying drawings.

The terms including an ordinal number such as first, second, etc. may be used to describe various components, but the components are not limited by such terms. The terms are used only for the purpose of distinguishing one component from other components.

When any component is described as "being connected" or "being coupled" to other component, this should be understood to mean that still another component may exist between them, although the any component may be directly connected or coupled to the other component. In contrast, when any component is described as "being directly connected" or "being directly coupled" to other component, this should be understood to mean that no component exists between them.

A singular expression can include a plural expression as long as it does not have an apparently different meaning in context.

In the present disclosure, terms "include" and "have" should be understood to be intended to designate that illustrated features, numbers, steps, operations, components, parts or combinations thereof are present and not to preclude the existence of one or more different features, numbers, steps, operations, components, parts or combinations thereof, or the possibility of the addition thereof.

A display device described in the present disclosure can be implemented as a display device such as TV, smart TV, network TV, hybrid broadcast broadband television (HBBTV), Internet TV, Web TV, Internet protocol television (IPTV), digital signage, desktop computer, cellular phone, smart phone, laptop computer, digital broadcasting terminal, personal digital assistant (PDA), portable multimedia player (PMP), navigation, slate PC, tablet PC, ultrabook, and wearable device. The wearable device includes a smart watch, a smart glass, a head mounted display (HMD), and the like. The display device can be implemented as a PDP, a LCD, an OLED display, a quantum dot (QD) display, a QD LED display, and the like.

The present disclosure enlarges a size of an input image and crops the enlarged image to select an image to be displayed on a screen of a display panel. The present disclosure displays the cropped image on the screen and varies a location of a cropping area every predetermined time. Thus, the present disclosure can prevent a burn-in phenomenon and minimize a dark portion that is at an edge of the screen and does not have pixel data, by moving a location of a fixed pattern displayed on the screen every predetermined time.

Hereinafter, an input image is referred to as "first image", an enlarged image is referred to as "second image", and an image selected by the cropping processing is referred to as "third image". The third image is a portion of the second image. Thus, the third image is selected with the smaller size than the second image in the cropping process.

Referring to FIGS. 1 and 2, an image processing method according to the present disclosure enlarges a first image 10 to a size greater than a screen size of a display panel to generate a second image 20. The first image 10 includes a fixed pattern (e.g., text, image, etc.) 201 that may cause the burn-in phenomenon, and has a predetermined resolution. A typical example of the fixed pattern includes logo. A display device according to the present disclosure prevents the burn-in phenomenon by moving the first image 10 including the fixed pattern 201 in the screen of the display panel.

The resolution of the first image may be Win*Hin. When a screen resolution of the display panel is W×H, where W and H are a natural number, the present disclosure may overscan the first image to enlarge the first image to a size equal to or greater than the screen of the display panel. An example of the overscan method includes an up-scaling method for increasing the resolution of the first image. As a result of overscan, a resolution of the second image may increase to (W+a)*(H+ß), where a is a natural number that is greater than zero and less than W, and ß is a natural number that is greater than zero and less than H.

The image processing method according to the present disclosure crops a portion of the second image to be displayed on the screen of the display panel to generate a third image 30. The resolution of the second image 20 is greater than a resolution of the screen of the display panel, and a resolution of the third image 30 is less than the resolution of the screen of the display panel. Because the third image 30 and the screen of the display panel have the very similar resolution, the size of the third image 30 is very similar to the screen size of the display panel. The resolution of the second image 20 increases further than the resolution of the third image 30 displayed on the screen of the display panel through the up-scaling.

Because the second image 20 is enlarged further than the screen of the display panel, an overscan image 21 that is not selected in the cropping process exists in the second image 20. The overscan area 21 is a portion of the second image 20 that is not displayed on the screen.

The image processing method according to the present disclosure changes a location of the fixed pattern 201 on the screen of the display panel by changing a location of a cropping area in the second image every predetermined time. When the location of the cropping area changes, there are changes in locations of the third image 30 and the overscan area 21 displayed on the screen in the second image. The third image 30 is a cropped image selected in the cropping process.

As illustrated in FIG. 2, the cropping method removes pixel data as much as the overscan area 21 positioned at an edge of the second image along an X-axis direction, and removes pixel data as much as the overscan area 21 positioned at an edge of the second image along a Y-axis direction. A length of the overscan area 21 in the X-axis direction is 'a', and a length of the overscan area 21 in the Y-axis direction is B. As a result of cropping, the size of the third image 30 is exactly the same as the screen size of the display panel. Because the third image 30 is cropped in the second image 20, the black portion not having pixel data is not visible on the screen even if the third image 30 moves on the screen.

The overscan area in the second image 20 varies depending on a location deleted in the cropping process. In FIG. 2, x is an offset removed along the X-axis direction, and y is an offset removed along the Y-axis direction. x is selected between zero and a, and y is selected between zero and B. Top, bottom, left, and right overscan widths of the second image 20 are determined depending on the overscan offsets x and y. In the present disclosure, the cropping method varies the overscan offsets x and y every predetermined time so that the fixed pattern displayed on the screen moves.

FIG. 3 illustrates an example of varying a location of a third area displayed on a display panel in a second image by varying a location of a cropping area.

Referring to FIG. 3, an image processing method according to the present disclosure varies a location of a third image 30 in a second image 20 by changing a location of a cropping area in the second image 20 every predetermined time.

In FIG. 3, a dot positioned at an uppermost end and a leftmost side of the third image indicates a first pixel data location displayed on a first pixel positioned at an uppermost end and a leftmost side on the screen of the display panel.

The cropping area location is determined depending on overscan offsets x and y. In (A) of FIG. 3, the overscan offsets x and y are x=0 and y=0. In (A), the third image 30 is selected as an image that is upwardly shifted by ß from the center of the second image 20 and is shifted by 'a' from the center of the second image 20 to the left. In (A), the first pixel data location of the third image 30 is (x=0, y=0) and is the same location as first pixel data of the second image 20.

In (B) of FIG. 3, the overscan offsets x and y are x=a and y=0. In (B), the third image 30 is selected as an image that is upwardly shifted by ß from the center of the second image 20 and is shifted by 'a' from the center of the second image 20 to the right. In (B), the first pixel data location of the third image 30 is (x=a, y=0). The first pixel data location (x=0, y=0) of the second image 20 is not changed and exists in the overscan area.

In (C) of FIG. 3, the overscan offsets x and y are x=0 and y=ß. In (C), the third image 30 is selected as an image that is downwardly shifted by ß from the center of the second image 20 and is shifted by 'a' from the center of the second image 20 to the left. In (C), the first pixel data location of the third image 30 is (x=0, y=ß). The first pixel data location (x=0, y=0) of the second image 20 is not changed and exists in the overscan area.

In (D) of FIG. 3, the overscan offsets x and y are x=a and y=ß. In (D), the third image 30 is selected as an image that is downwardly shifted by ß from the center of the second image 20 and is shifted by 'a' from the center of the second image 20 to the right. In (D), the first pixel data location of the third image 30 is (x=a, y=ß). The first pixel data location (x=0, y=0) of the second image 20 is not changed and exists in the overscan area.

The image processing method according to the present disclosure varies the location of the cropping area each time a predetermined time elapses so that the fixed pattern 201 moves in the screen of the display panel. For example, the third image 30 may move by one pixel in order of (A), (B), (C) and (D) of FIG. 3 so that the third image 30 moves clockwise in the second image 20 every 3 minutes. However, embodiments are not limited thereto. For example, the cropping location and the cropping order of the third image 30 in the second image 20 can be selected in various methods.

The image processing method according to the present disclosure can move the fixed pattern 201, and at the same time control a luminance of the fixed pattern 201 to be less than a luminance of a fixed pattern in an input image, i.e., the first image, using the above-described method for varying the cropping area location, in order to increase an effect of suppressing the burn-in phenomenon.

FIG. 4 is a block diagram illustrating a display device according to a first embodiment of the present disclosure.

Referring to FIG. 4, a display device according to the present disclosure includes an image processing unit 100 and a display 200. The image processing unit 100 includes an image analysis unit 101, an overscan generator 102, and a cropping processing unit 103.

The image analysis unit 101 analyzes pixel data of a first image 10 and detects a fixed pattern 201 that may cause the burn-in phenomenon. The image analysis unit 101 may analyze the first image 10 using a frame comparison method and detect a fixed pattern not having a movement in the first image.

The overscan generator 102 generates pixel data of a second image 20, of which a resolution is increased to be greater than a screen resolution of the display panel, by using up-scaling of the first image 10. The overscan generator 102 generates the second image 20 when the first image 10 including the fixed pattern 201 is input under the control of the image analysis unit 101, and converts a resolution of the first image 10 into a resolution of the display panel when the first image 10 not including the fixed pattern 201 is input.

The cropping processing unit 103 crops the second image 20 input from the overscan generator 102, selects a third image 30 to be displayed on the screen of the display panel in the second image 20, and transmits pixel data of the third image 30 to the display 200. The cropping processing unit 103 does not transmit pixel data of the overscan area 21 defined as the overscan offsets x and y to the display 200.

When there is no fixed pattern 201 in the first image 10, the overscan generator 102 may convert and output the resolution of the first image 10 to match the resolution of the display panel 100. In this case, the cropping processing unit 103 may bypass as it is pixel data of the first image 10 from the overscan generator 102 to the display 200 without the cropping processing.

FIG. 5 is a block diagram illustrating a display device according to a second embodiment of the present disclosure. In FIG. 5, components that are substantially the same as the components illustrated in FIG. 4 are designated by the same reference numerals, and the description thereof will be omitted.

Referring to FIG. 5, the image processing unit 100 includes an image analysis unit 101, a luminance adjustment unit 104, an overscan generator 102, and a cropping processing unit 103.

The luminance adjustment unit 104 reduces a luminance of a fixed pattern 201 detected by the image analysis unit 101 by a predetermined luminance reduction amount to relieve a stress of pixels to which pixel data of the fixed pattern is applied.

The overscan generator 102 enlarges a first image 10, in which the luminance of the fixed pattern is reduced, and generates pixel data of a second image 20. When there is no fixed pattern 201 in the first image 10, the overscan generator 102 converts a resolution of the first image 10 into a resolution of the display panel.

The cropping processing unit 103 crops the second image 20 input from the overscan generator 102, selects a third image 30 to be displayed on the screen of the display panel in the second image 20, and transmits pixel data of the third image 30 to the display 200. The cropping processing unit 103 does not transmit pixel data of the overscan area 21 defined as the overscan offsets x and y to the display 200. If the first image, of which a resolution is converted to match a resolution of the display panel, is output from the overscan generator 102, the cropping processing unit 103 may bypass as it is pixel data of the first image 10 from the overscan generator 102 to the display 200 without the cropping processing.

The image processing unit 100 may generate the second image including an overscan area 21 for all images with or without the fixed pattern, and generate the third image, of which a resolution is converted into the resolution of the display panel. In this case, the image analysis unit 101 may be omitted in FIGS. 4 and 5.

The display 200 displays pixel data of an image received from the cropping processing unit 103 on the screen. The display 200 may include a display panel and a display panel driver. Pixel data of an image output from the image processing unit 100 is transmitted to the display panel driver.

The screen of the display panel includes a pixel array displaying an input image. The pixel array includes a plurality of data lines, a plurality of gate lines (or scan lines) crossing the data lines, and pixels arranged in a matrix form. Each pixel may be divided into a red subpixel, a green subpixel, and a blue subpixel for color representation. Each pixel may further include a white subpixel.

Touch sensors may be disposed on the display panel. The touch input may be sensed using separate touch sensors or sensed through the pixels. The touch sensors may be implemented as on-cell type touch sensors or add-on type touch sensors which are disposed on the screen of the display panel, or implemented as in-cell type touch sensors which are embedded in the pixel array.

The display panel driver applies pixel data of an input image received from the image processing unit 100 to the pixels of the display panel and displays the input image on the screen of the display panel. The display panel driver includes a data driver, a gate driver (or scan driver), and a timing controller (TCON). The display panel driver may further include a touch sensor driver for driving the touch sensors. In a mobile device, a timing controller, a data driver, and a power circuit may be integrated into one drive IC chip.

The data driver converts digital data of an input image received from the timing controller into analog gamma compensation voltages using a digital-to-analog converter (DAC) in each frame period to output data voltages. The gate driver may sequentially supply gate signals (or scan signals) synchronized with the data voltages to the gate lines using a shift register under the control of the timing controller.

The timing controller receives pixel data (digital data) of an image and timing signals synchronized with the pixel data from the image processing unit 100. The timing controller transmits the pixel data to the data driver and controls operation timing of the data driver and the gate driver.

FIGS. 6 and 7 are flow charts illustrating an image processing method according to an embodiment of the present disclosure.

Referring to FIG. 6, the image processing unit 100 detects a fixed pattern from a first image in S1 and S2. The image processing unit 100 enlarges the first image to generate a second image including an overscan area 21, and then selects a cropped area excluding the overscan area 21 from the second image through a cropping processing to generate a third image S3 and S4. The third image has a resolution very similar to a resolution of a screen of a display panel.

The image processing unit 100 transmits pixel data of the third image to the display 200. The display 200 applies the pixel data of the third image to pixels of the display panel and displays the third image on the screen of the display panel in S5. The image processing unit 100 changes a location of a cropping area after a predetermined time elapses, and moves the third image in the second image in S6 and S7. As a result, the fixed pattern 201 is moved by a movement amount of the cropping area location on the screen of the display panel.

If there is no fixed pattern 201 in the first image, the image processing unit 100 may convert a resolution of the first image to match a screen resolution of the display panel and may transmit the first image to the display 200 in S8 and S9.

As illustrated in FIG. 7, in order to increase an effect of suppressing the burn-in phenomenon, the image processing unit 100 may reduce a luminance of the fixed pattern 201 by a predetermined luminance reduction amount if the fixed pattern 201 is detected in the first image 10 in S10.

As illustrated in FIG. 8, the display device according to the present disclosure can be applied to various display devices including a stationary display device (see (A)), a display device of a mobile terminal (see (B)), etc. A typical example of the stationary display device may include TV, a computer monitor, etc. Examples of the mobile terminal may include a cellular phone, a smart phone, a wearable device, etc. The display device according to the present disclosure may include the image processing unit 100 and the display 200 that are described above.

FIG. 9 is a block diagram schematically illustrating a mobile terminal.

Referring to FIG. 9, a mobile terminal may include a wireless communication unit 110, an input unit 120, a sensing unit 140, an output unit 150, an interface unit 160, a memory 170, a controller 180, a power supply unit 190, and the like. It is understood that implementing all the components illustrated in FIG. 16 is not a requirement for the mobile terminal, and that more or fewer components may alternatively be implemented.

The wireless communication unit 110 may include one or more modules which allows wireless communications between a mobile terminal and a wireless communication system, between a mobile terminal and another mobile terminal, or between a mobile terminal and an external server. Further, the wireless communication unit 110 may include one or more modules which connect the mobile terminal to one or more networks.

The wireless communication unit 110 may include at least one of a broadcast receiving module 111, a mobile communication module 112, a wireless Internet module 113, a short-range communication module 114, or a location information module 115.

The input unit 120 may include a camera 121 which is one type of an image input unit for inputting an image signal, a microphone 122 which is one type of an audio input unit for inputting an audio signal, and a user input unit 123 (e.g., touch key, push key, mechanical key, etc.) for allowing a user to input information. Audio data or image data obtained by the input unit 120 may be analyzed and processed by user control commands.

The sensing unit 140 may include one or more sensors for sensing at least one of internal information of the mobile terminal, information about a surrounding environment of the mobile terminal, and user information. For example, the sensing unit 140 may include at least one of a proximity sensor 141, an illumination sensor 142, a touch sensor, an acceleration sensor, a magnetic sensor, a G-sensor, a gyroscope sensor, a motion sensor, an RGB sensor, an infrared (IR) sensor, a fingerprint sensor, a ultrasonic sensor, an optical sensor (e.g., camera 121), the microphone 122, a battery gauge, an environment sensor (e.g., a barometer, a hygrometer, a thermometer, a radiation detection sensor, a thermal sensor, a gas sensor, etc.), and a chemical sensor (e.g., an electronic nose, a health care sensor, a biometric sensor, etc.). The mobile terminal may combine and utilize information obtained from two or more sensors of the sensing unit 140.

The output unit 150 may be configured to output various types of information related to audio, video, tactile output, and the like. The output unit 150 may include at least one of a display 200, an audio output unit 152, a haptic module 153, or an optical output unit 154. The display 200 may have an inter-layered structure or an integrated structure with a touch sensor to implement a touch screen. The touch screen may provide an output interface between the mobile terminal and the user, as well as function as the user input unit 123 which provides an input interface between the mobile terminal and the user.

The interface unit 160 serves as an interface with various types of external devices that are coupled to the mobile terminal. The interface unit 160 may include at least one of wired/wireless headset ports, external charger ports, wired/wireless data ports, memory card ports, ports for connecting a device having an identification module, audio input/output (I/O) ports, video I/O ports, or earphone ports. The mobile terminal 100 may perform assorted control functions related to a connected external device, in response to the external device being connected to the interface unit 160.

The memory 170 stores data supporting various functions of the mobile terminal. For instance, the memory 170 may store multiple application programs or applications executed in the mobile terminal 100, data or instructions for operations of the mobile terminal 100, and the like. At least some of these application programs may be downloaded from an external server via wireless communication. Other application programs may be installed within the mobile terminal 100 at time of manufacturing or shipping, which is typically the case for basic functions (e.g., receiving a call, placing a call, receiving a message, sending a message, and the like) of the mobile terminal 100. It is common for application programs to be stored in the memory 170, installed in the mobile terminal, and executed by the controller 180 to perform an operation (or function) for the mobile terminal.

The controller 180 functions to control overall operation of the mobile terminal. The controller 180 may provide or process information or functions suitable for the user by processing signals, data, information and the like, which are input or output by the components mentioned above, or activating application programs stored in the memory 170. The controller 180 may control at least some of the components illustrated in FIG. 2 according to the execution of an application program that have been stored in the memory 170. In addition, the controller 180 may combine and operate at least two of the components included in the mobile terminal for the execution of the application program. The image processing unit 100 described above may be disposed in the controller 180.

The power supply unit 190 receives external power and internal power and supplies power to the respective components included in the mobile terminal under the control of the controller 180. The power supply unit 190 may include a battery, and the battery may be configured to be embedded in the device body, or configured to be detachable from the device body.

At least some of the respective components may be combined with one another and operate, in order to implement the operation, the control, or the control method of the mobile terminal according to various embodiments described below. Further, the operation, the control, or the control method of the mobile terminal according to various embodiments may be implemented on the mobile terminal by an execution of at least one application program stored in the memory 170.

Before describing various embodiments implemented through the mobile terminal, the components mentioned above are described in detail below.

Regarding the wireless communication unit 110, the broadcast receiving module 111 receives broadcast signal and/or broadcast related information from an external broadcast managing server via a broadcast channel. The broadcast channel may include a satellite channel and a terrestrial channel. Two or more broadcast receiving modules 111 may be provided to the mobile terminal to facilitate simultaneously receiving of at least two broadcast channels, or to support switching among broadcast channels. The broadcast managing server may indicate a sever configured to generate and transmit broadcast signal and/or broadcast related information or a sever configured to receive pre-generated broadcast signal and/or broadcast related information and transmit it to a terminal. The broadcast signal may include a TV broadcast signal, a radio broadcast signal, and a data broadcast signal, and further include a broadcast signal in combination form of a TV broadcast signal or a radio broadcast signal and a data broadcast signal. The broadcast signal may be encoded according to at least one of technical standards (or broadcast methods, e.g., ISO, IEC, DVB, ATSC, etc.) for transmitting and receiving digital broadcast signals, and the broadcast receiving module 111 may receive a digital broadcast signal using a method suitable for the technical standard determined by the technical standards. The broadcast related information may indicate information related to a broadcast channel, a broadcast program or a broadcast service provider. The broadcast related information may also be provided via a mobile communication network. In this case, it may be received the mobile communication module 112.

For example, the broadcast related information may exist in various types including an electronic program guide (EPG) of digital multimedia broadcasting (DMB) or an electronic service guide (ESG) of digital video broadcast-handheld (DVB-H), etc. The broadcast signal and/or the broadcast related information received through the broadcast receiving module 111 may be stored in the memory 160.

The mobile communication module 112 transmits and receives wireless signals to and from at least one of a base station, an external user equipment, and a server on a mobile communication network which is constructed according to technical standards or communication methods for mobile communications (e.g., Global System for Mobilecommunication (GSM), Code Division MultiAccess (CDMA), Code Division MultiAccess2000 (CDMA2000), Enhanced Voice-Data Optimized or Enhanced Voice-Data Only (EVDO), Wideband CDMA (WCDMA), High Speed Downlink Packet Access (HSDPA), High Speed Uplink Packet Access (HSUPA), Long Term Evolution (LTE), Long Term Evolution-Advanced (LTE-A), etc.). Examples of the wireless signals may include audio call signals, video call signals, or various formats of data to support communication of text/multimedia messages.

The wireless Internet module 113 is configured to facilitate wireless Internet access. This module may be internally or externally coupled to the mobile terminal. The wireless Internet module 113 is configured to transmit and receive wireless signals via communication networks according to wireless Internet technologies. Examples of the wireless Internet technologies include Wireless LAN (WLAN), Wireless Fidelity (Wi-Fi), Digital Living Network Alliance (DLNA), Wireless Broadband (WiBro), World Interoperability for Microwave Access (WiMAX), High Speed Downlink Packet Access (HSDPA), High Speed Uplink Packet Access (HSUPA), Long Term Evolution (LTE), Long Term Evolution-Advanced (LTE-A), etc. The wireless Internet module 113 may transmit/receive data according to at least one wireless Internet technology within the range including up to Internet technologies that are not described above. When the wireless Internet access is implemented according to, for example, WiBro, HSDPA, HSUPA, GSM, CDMA, WCDMA, LTE, LTE-A, etc., as part of a mobile communication network, the wireless Internet module 113 that performs the wireless Internet access via the mobile communication network can be understood as a type of the mobile communication module 112.

The short-range communication module 114 is configured to facilitate short-range communications. The short-range communication module 114 may support the short-range communications using at least one of Bluetooth™, Radio Frequency Identification (RFID), Infrared Data Association (IrDA), Ultra Wideband (UWB), ZigBee, Near Field Communication (NFC), Wireless-Fidelity (Wi-Fi), Wi-Fi Direct, Wireless Universal Serial Bus (USB) technologies.

The short-range communication module 114 may support wireless communications between the mobile terminal and a wireless communication system, between the mobile terminal and another mobile terminal, or between the mobile terminal and a network where another mobile terminal 100 (or an external server) is located, via short-range wireless area networks. The short-range wireless area networks are short-range wireless personal area networks. In some embodiments, another mobile terminal may be a wearable device which is able to exchange (or cooperate) data with the mobile terminal according to the present disclosure, for example, a smart watch, a smart glass or a head mounted display (HMD). The short-range communication module 114 may sense (or recognize) the wearable device that is around the mobile terminal and is able to communicate with the mobile terminal. In addition, when the sensed wearable device is a device which is authenticated to communicate with the mobile terminal according to the present disclosure, the controller 180 may transmit at least a portion of data processed in the mobile terminal to the wearable device via the short-range communication module 114. Thus, a user of the wearable device may use data processed in the mobile terminal on the wearable device. For example, when a call is received in the mobile terminal, the user may answer the call using the wearable device. Also, when a message is received in the mobile terminal, the user can check the received message using the wearable device.

The location information module 115 is configured to obtain a location (or a current location) of the mobile terminal. As a typical example, the location information module 115 includes a global positioning system (GPS) module or a Wi-Fi module. For example, when the mobile terminal uses a GPS module, a location of the mobile terminal may be acquired using a signal sent from a GPS satellite. As another example, when the mobile terminal uses the Wi-Fi module, a location of the mobile terminal may be acquired based on information related to a wireless access point (AP) which transmits or receives a wireless signal to or from the Wi-Fi module. If necessary or desired, the location information module 115 may alternatively or additionally perform any function of other modules of the wireless communication unit 110 to obtain data related to the location of the mobile terminal. The location information module 115 is a module used to obtain the location (or current location) of the mobile terminal, and is not limited to a module configured to directly calculate or obtain the location of the mobile terminal.

The input unit 120 is configured to input image information (or image signals), audio information (or audio signals), data, or information input from the user. The input unit 120 may include one camera or multiple cameras 121 for the input of image information. The camera 121 may process image frames of still picture or video obtained by image sensors in a video call mode or a video capture mode. The processed image frames may be displayed on the display 200 or stored in the memory 170. The plurality of cameras 121 included in the mobile terminal may be arranged in a matrix format and allow multiple image information with various angles or focal points to be input to the mobile terminal. Further, the plurality of cameras 121 may be disposed in a stereoscopic arrangement to acquire left and right images for implementing a stereoscopic image.

The microphone 122 processes an external audio signal into electrical voice data. The processed voice data can be variously utilized according to functions (or application program being executed) being performed in the mobile terminal. The microphone 122 may implement various noise removing algorithms for removing a noise generated in the process of receiving the external audio signal.

The user input unit 123 is configured to receive information from the user. When information is input through the user input unit 123, the controller 180 may control operation of the mobile terminal in response to the input information. The user input unit 123 may include one or more of a mechanical input means (or a mechanical key, e.g., a button, a dome switch, a jog wheel, a jog switch, etc. located on front and rear surfaces or a side surface of the mobile terminal), and a touch input means. As one example, the touch input means may include a virtual key, a soft key, or a visual key which is displayed on a touch screen through software processing, or may include a touch key which is located on the mobile terminal at a location other than the touch screen. The virtual key or the visual key can be displayed on the touch screen in various shapes, for example, graphic, text, icon, video, or a combination thereof.

The sensing unit 140 is configured to sense at least one of internal information of the mobile terminal, surrounding environment information of the mobile terminal, and user information and generate sensing signals corresponding to this information. Based on the sensing signals, the controller 180 may control execution or operation of the mobile terminal or perform data processing, a function or an operation related to an application program installed in the mobile terminal. Typical sensors of various sensors that may be included in the sensing unit 140 are described in more detail.

The proximity sensor 141 refers to a sensor that senses presence or absence of an object approaching a predetermined detection surface, or an object located near a predetermined detection surface, by using an electromagnetic field or infrared rays, etc. without a mechanical contact. The proximity sensor 141 may be disposed at an inner area of the mobile terminal covered by the touch screen described above, or near the touch screen.

Examples of the proximity sensor 141 may include a transmissive photoelectric sensor, a direct reflective photoelectric sensor, a mirror reflective photoelectric sensor, a high-frequency oscillation proximity sensor, a capacitive proximity sensor, a magnetic proximity sensor, an infrared rays proximity sensor, and the like. When the touch screen is implemented as a capacitive type, the proximity sensor 141 may be configured to detect an approach of an object with conductivity by changes of an electromagnetic field which is responsive to the approach of the object with conductivity. In this case, the touch screen (touch sensor) itself may be categorized as a proximity sensor.

For the convenience of explanation, the term "proximity touch" is referred to a behavior that is recognized such that an object is positioned on the touch screen to be proximate to the touch screen without contacting the touch screen, and the term "contact touch" is referred to a behavior that an object actually contacts the touch screen. For the position corresponding to the proximity touch of the object relative to the touch screen, the position corresponds to a position where the object is perpendicular to the touch screen. The proximity sensor 141 may sense a proximity touch and a proximity touch pattern (e.g., proximity touch distance, proximity touch direction, proximity touch speed, proximity touch time, proximity touch location, proximity touch moving state, etc.). The controller 180 may process data (or information) corresponding to a proximity touch operation and the proximity touch pattern sensed by the proximity sensor 141, and may also output visual information corresponding to the processed data on the touch screen. In addition, the controller 180 may control the mobile terminal to execute different operations or process different data (or information) depending on whether a touch with respect to the same location on the touch screen is a proximity touch or a contact touch.

The touch sensor senses a touch (or a touch input) applied to the touch screen (or the display 200) using at least one of various touch methods including a resistive type, a capacitive type, an infrared type, an ultrasonic type, a magnetic field type, etc. The touch sensor may be configured to convert changes of a pressure applied to a specific part of the touch screen or a capacitance occurring at the specific part into electric input signals. The touch sensor may be configured so that a touch object applying a touch input to the touch screen can detect a touched position and a touched area on the touch sensor, a touch pressure, a touch capacitance, etc. The touch object is used to apply a touch input to the touch sensor. Examples of the touch objects may include a finger, a touch pen, a stylus pen, a pointer, etc.

When a touch input is sensed by a touch sensor, signal(s) corresponding to the touch input may be sent to a touch controller. The touch controller processes the signals, and then transmits corresponding data to the controller 180. Hence, the controller 180 may sense which area of the display 200 has been touched. The touch controller may be a separate component from the controller 180, and may be embedded in the controller 180.

The controller 180 may perform the same control or different controls according to a type of touch object that touches the touch screen (or a touch key provided in addition to the touch screen). Whether to perform the same control or different controls according to the type of touch object may be decided based on a current operating state of the mobile terminal or a currently executed application program.

The touch sensor and the proximity sensor may be implemented individually or in combination, to sense various types of touches including a short (or tap) touch, a long touch, a multi-touch, a drag touch, a flick touch, a pinch-in touch, a pinch-out touch, a swipe touch, a hovering touch, and the like.

An ultrasonic sensor may recognize location information of a touch object using ultrasonic waves. The controller 180 can calculate a location of a wave generation source based on information sensed by an optical sensor and a plurality of ultrasonic sensors. The location of the wave generation source can be calculated using the property that light is much faster than ultrasonic waves, i.e., the time it takes for light to reach the optical sensor is much shorter than the time it takes for the ultrasonic waves to reach the ultrasonic sensor. More specifically, the location of the wave generation source can be calculated using a difference between the time it takes for light to reach the optical sensor and the time it takes for the ultrasonic waves to reach the ultrasonic sensor.

The camera 121 includes at least one of a camera sensor (e.g., CCD, CMOS, etc.), a photo sensor (or image sensor), and a laser sensor. The camera 121 and a laser sensor may be combined with each other to sense a touch of a sensing object for a three-dimensional (3D) stereoscopic image. The photo sensor may be laminated on the display device, and the laminated photo sensor may be configured to scan a movement of the sensing object adjacent to the touch screen. More specifically, the photo sensor may include photo diodes and transistors (TRs) on rows and columns to scan contents placed on the photo sensor using an electrical signal which varies depending on an amount of light applied to the photo diodes. Namely, the photo sensor may calculate coordinates of the sensing object depending on changes in the amount of light to obtain location information of the sensing object.

The display 200 is configured to display (output) information processed in the mobile terminal. The display 200 may display execution screen information of an application program executed in the mobile terminal, or user interface (UI) and graphic user interface (GUI) information in response to the execution screen information.

The image processing unit 100 enlarges a first image received from an image input unit to generate an overscan image, i.e., a second image, performs a cropping processing at a predetermined location to select a third image to be displayed on the screen of the display panel in the second image, and transmits it to the display 200. The image processing unit 100 moves a location of a fixed pattern 201 on the screen of the display panel by changing a location of a cropping area each time a predetermined time elapses, thereby preventing the burn-in phenomenon. Because the location of the cropping area changes in the enlarged second image, a portion that is processed as black (or blank) since there is no pixel data is not visible on the screen even if an image moves on the screen of the display panel.

The display 200 may be implemented as a 3D display for displaying a 3D image. The 3D display may employ a 3D display scheme such as a stereoscopic scheme (a glass scheme), an auto-stereoscopic scheme (glassless scheme), and a projection scheme (holographic scheme).

The 3D image may consist of a left image (or left eye image) and a right image (or right eye image). Examples of a method for combining the left image and the right image into the 3D mage may include a top-down method in which the left image and the right image are arranged up and down in one frame, a left-to-right (L-to-R) (or side by side) method in which the left image and the right image are arranged left and right in one frame, a checkerboard method in which pieces of the left image and the right image are arranged in a tile form, an interlaced method in which the left images and the right images are alternately arranged on a per row basis or on a per column basis, and a time sequential (or frame by frame) method in which the left images and the right images are alternately displayed on a per time basis.

A 3D thumbnail image may be generated as one image by generating a left image thumbnail and a right image thumbnail from a left image and a right image of an original image frame, respectively, and combining them. The thumbnail generally refers to a reduced video or a reduced still image. The left image thumbnail and the right image thumbnail thus generated are displayed on the screen with a left-right distance difference as much as a depth corresponding to a parallax between the left image and the right image, and thus can show a three-dimensional sense of space.

The left image and the right image required to implement the 3D image may be displayed on a 3D display by a 3D processing unit. The 3D processing unit is configured to receive a 3D image (an image at a reference time and an image at an extended time) and set a left image and a right image from the 3D image, or receive a 2D image and switch the 2D image into a left image and a right image.

The audio output unit 152 may be configured to output audio data that is received from the wireless communication unit 110 or is stored in the memory 170, in a call signal reception mode, a call mode, a record mode, a voice recognition mode, a broadcast reception mode, etc. The audio output unit 152 may output audio signals related to a function (e.g., a call signal reception sound, a message reception sound, etc.) performed by the mobile terminal. The audio output unit 152 may include a receiver, a speaker, a buzzer, or the like.

The haptic module 153 is configured to generate various tactile effects that a user can feel, perceive, or experience. A typical example of the tactile effect generated by the haptic module 153 may be vibration. A strength, a pattern, etc. of the vibration generated by the haptic module 153 may be controlled by user's selection or setting of the controller. The haptic module 153 may combine different vibrations to output the vibration, or may sequentially output different vibrations. In addition to the vibration, the haptic module 153 may generate various tactile effects, including an effect by stimulation such as a pin arrangement vertically moving to a contact skin surface, a spray force or a suction force of air through a jet orifice or a suction opening, a touch to the skin surface, a contact of an electrode, and electrostatic force, an effect by reproducing the sense of cold and warmth using an element that can absorb or generate heat, and the like.

The haptic module 153 may also be implemented to allow the user to feel a tactile effect through a muscle sensation such as the user's finger or arm, as well as transferring the tactile effect through direct contact. Two or more haptic modules 153 may be provided according to the configuration of the mobile terminal.

The optical output unit 154 outputs a signal for informing an event generation using light of a light source of the mobile terminal. Examples of events generated in the mobile terminal may include message reception, call signal reception, a missed call, an alarm, schedule notice, email reception, information reception through an application, and the like.

A signal output by the optical output module 154 may be implemented in such a manner that the mobile terminal emits forward or rearward monochromatic light or light with a plurality of colors. The output signal of the optical output module 154 may be terminated as the mobile terminal senses that a user has checked the generated event.

The interface unit 160 serves as an interface for all of external devices to be connected to the mobile terminal. The interface unit 160 may receive data from an external device, receive power to transfer the power to the respective components inside the mobile terminal, or transmit internal data of the mobile terminal to the external device. For example, the interface unit 160 may include wired/wireless headset ports, external charger ports, wired/wireless data ports, memory card ports, ports for connecting a device having an identification module, audio input/output (I/O) ports, video I/O ports, earphone ports, and the like.

The identification module may be a chip that stores various information for authenticating the use authority of the mobile terminal and may include a user identity module (UIM), a subscriber identity module (SIM), a universal subscriber identity module (USIM), and the like. In addition, the device having the identification module (hereinafter referred to as 'identification device') may take the form of a smart card. Thus, the identification device may be connected to the mobile terminal 100 via the interface unit 160.

When the mobile terminal is connected to an external cradle, the interface unit 160 may serve as a passage to allow power from the cradle to be supplied to the mobile terminal or serve as a passage to allow various command signals input by the user from the cradle to be transferred to the mobile terminal. The various command signals or the power input from the cradle may operate as signals for recognizing that the mobile terminal is accurately mounted on the cradle.

The memory 170 may store programs for operations of the controller 180 and temporarily store input/output data (e.g., phonebook, messages, still images, videos, etc.). The memory 170 may store data related to various patterns of vibration and audio which are output upon the touch input on the touch screen.

The memory 170 may include at least one type of storage medium among a flash memory, a hard disk, a solid state disk (SSD), a silicon disk drive (SDD), a multimedia card micro, a card memory (e.g., SD or XD memory, etc.), a random access memory (RAM), a static random access memory (SRAM), a read-only memory (ROM), an electrically erasable programmable read-only memory (EEPROM), a programmable read-only memory (PROM), a magnetic memory, a magnetic disk, and an optical disk. The mobile terminal may also operate in relation to a web storage that performs the storage function of the memory 170 over the Internet.

As described above, the controller 180 may typically control the general operations of the mobile terminal and an operation related to an application program. For example, the controller 180 may execute or release a locked state for restricting the input of a control command of the user for applications when a state of the mobile terminal meets a preset condition.

The controller 180 may perform the control and processing related to voice calls, data communications, video calls, etc., or perform pattern recognition processing to recognize a handwriting input or a picture drawing input performed on the touch screen as texts and images. In addition, the controller 180 may control one or a combination of the above-described components in order to implement various embodiments described below on the mobile terminal according to the present disclosure.

The power supply unit 190 receives external power and internal power and supplies power required for operations of the respective components of the mobile terminal under the control of the controller 180. The power supply unit 190 may include a battery, and the battery is may be a rechargeable built-in battery and may be detachably coupled to the terminal body for charging.

The power supply unit 190 may include a connection port. The connection port may be configured as one example of the interface unit 160 to which an external charger for supplying power to recharge the battery is electrically connected. As another example, the power supply unit 190 may be configured to recharge the battery in a wireless manner without use of the connection port. In this case, the power supply unit 190 may receive power from an external wireless power transmitter using at least one of an inductive coupling method based on a magnetic induction phenomenon or a magnetic resonance coupling method based on an electromagnetic resonance phenomenon.

FIGS. 10 and 11 are block diagrams illustrating an example of a stationary display device.

Referring to FIGS. 10 and 11, a display device may include a receiver 310, an external device interface unit 320, a display 200, an audio output unit 350, a power supply unit 360, a controller 370, a user interface unit 380, and the like.

The receiver 310 may include a tuner 311, a demodulator 312, and a network interface unit 313. If necessary or desired, the receiver 310 may include the tuner 311 and the demodulator 312, but may not include the network interface unit 313, and vice versa. Although not shown, the receiver 310 may include a multiplexer to multiplex a signal, that is demodulated by the demodulator 312 via the tuner 311, and a signal received via the network interface unit 313. In addition, although not shown, the receiver 310 may include a demultiplexer to demultiplex the multiplexed signal or demultiplex the demodulated signal or the signal received via the network interface unit 313.

The tuner 311 receives a radio frequency (RF) broadcast signal by tuning a channel selected by a user or all pre-stored channels among RF broadcast signals received through an antenna. The tuner 311 converts the received RF broadcast signal into an intermediate frequency (IF) signal or a baseband signal. If the received RF broadcast signal is a digital broadcast signal, the tuner 311 converts it into a digital IF signal DIF. If the received RF broadcast signal is an analog broadcast signal, the tuner 311 converts it into an analog baseband video or audio signal CVBS/SIF. That is, the tuner 311 may process both the digital broadcast signal and the analog broadcast signal. The analog baseband video or audio signal CVBS/SIF output from the tuner 311 may be directly input to the controller 370.

The tuner 311 may receive a RF broadcast signal of a single carrier or multiple carriers. The tuner 311 may sequentially tune and receive RF broadcast signals of all broadcast channels stored through a channel storage function among RF broadcast signals received via an antenna, and convert them into a digital intermediate frequency signal or a baseband signal.

The demodulator 312 may receive and demodulate the digital IF signal DIF converted by the tuner 5610, and perform channel decoding. To this end, the demodulator 312 may include a Trellis decoder, a de-interleaver, a Reed-Solomon decoder, etc., or may include a convolution decoder, a de-interleaver, a Reed-Solomon decoder, etc.

The demodulator 312 may perform the demodulation and the channel decoding, and then output a stream signal TS. The stream signal may be a signal in which a video signal, an audio signal or a data signal are multiplexed. For example, the stream signal may be an MPEG-2 transport stream (TS) in which an MPEG-2 standard video signal, a Dolby AC-3 standard audio signal, etc. are multiplexed.

The stream signal output by the demodulator 312 may be input to the controller 370. The controller 370 may control demultiplexing, video/audio signal processing, and the like, and control an image output through the display 370 and an audio output through the audio output unit 350.

The external device interface unit 320 provides an interfacing environment between a display device and various external devices. To this end, the external device interface unit 320 may include an A/V input/output unit (not shown) or a wireless communication unit (not shown).

The external device interface unit 320 may be connected wiredly/wirelessly to an external device such as digital versatile disk (DVD), Blu-ray, game device, camera, camcorder, computer (notebook), tablet PC, smart phone, Bluetooth device, and cloud. The external device interface unit 320 transmits, to the controller 370, signals including data, such as an image, a video and audio, that are input from the outside through the connected external device. The controller 370 may be configured to output the data signal, such as the processed image, video and audio, to the connected external device. To this end, the external device interface unit 320 may further include an A/V input/output unit (not shown) or a wireless communication unit (not shown).

The A/V input/output unit may include a USB terminal, a composite video banking sync (CVBS) terminal, a component terminal, an S-video terminal (analog), a digital visual interface (DVI) terminal, a high definition multimedia interface (HDMI) terminal, an RGB terminal, a D-SUB terminal, and the like, so that video and audio signals of the external device can be input to the display device.

The wireless communication unit may perform wireless communication with other digital devices. The multimedia device 100 may be networked with other digital devices according to a communication protocol, for example, wireless LAN (WLAN), Wireless-Fidelity (Wi-Fi), Wi-Fi Direct, Bluetooth, radio frequency identification (RFID), infrared data association (IrDA), ultra wideband (UWB), ZigBee, digital living network alliance (DLNA), etc.

The external device interface unit 320 may be connected to a set-top box (STB) through at least one of various terminals described above and may perform input/output operations with the set-top box. The external device interface unit 320 may receive an application or an applications list in an adjacent external device and transmit it to the controller 370 or the memory 330.

The network interface unit 313 provides an interface for connecting the display device to a wired/wireless network including an Internet network. The network interface unit 313 may include an Ethernet terminal, etc. for connection with a wired network, and may use, for example, wireless LAN (WLAN) (Wi-Fi), wireless broadband (WiBro), world interoperability for microwave access (Wimax), high speed downlink packet access (HSDPA), Bluetooth™, radio frequency identification (RFID), infrared data association (IrDA), ultra wideband (UWB), ZigBee, near field communication (NFC), Wireless-Fidelity (Wi-Fi), Wi-Fi direct, wireless universal serial bus (USB), etc. for connection with a wireless network.

The network interface unit 313 may transmit or receive data with other users or other digital devices via a network or another network linked to the network. The network interface unit 313 may transmit data stored in a display device to a selected user or a selected digital device among other users or other digital devices that have been previously registered in the display device.

The network interface unit 313 may access a predetermined web page via a network or another network linked to the network. That is, the network interface unit 313 may access a predetermined web page via a network and may transmit or receive data with a corresponding server. In addition, the network interface unit 313 may receive contents or data provided by a content provider or a network operator. That is, the network interface unit 313 may receive contents such as movies, advertisements, games, VOD, and broadcast signals provided by a content provider or a network operator, and information related to the contents via the network. Further, the network interface unit 313 may receive update information and update files of firmware provided by a network operator. The network interface unit 313 may transmit data to the Internet or content provider or the network operator.

The network interface unit 313 may select and receive a desired application from among applications that are open via the network.

The memory 330 may store a program for processing and controlling each signal in the controller 370, and may also store a video signal, an audio signal, or a data signal that is processed.

The memory 330 may perform a function for temporarily storing the video, audio, or data signal input from the external device interface unit 320 or the network interface unit 313. The memory 330 may store information about a predetermined broadcast channel through a channel memory function.

The memory 330 may store an application or an application list input from the external device interface unit 320 or the network interface unit 313. The memory 330 may store various platforms to be described later. The memory 330 may include at least one type of storage medium among a flash memory, a hard disk, a multimedia card micro, a card memory (e.g., SD or XD memory, etc.), a RAM, and a ROM (e.g., EEPROM, etc.). The display device may play and provide content files (video files, still image files, music files, document files, application files, etc.) stored in the memory 330 to the user. In some embodiments, the memory 330 may be included and implemented in the controller 370.

The user interface unit 380 sends a signal input by the user to the controller 370 or sends a signal of the controller 370 to the user. The user interface unit 380 may receive, from a user input unit 300, a control signal related to power on/off, channel selection, and screen setting and process it, or may perform processing for sending a control signal of the controller 370 to the user input unit 300. The user input unit 300 may include at least one of a wired input unit receiving a user input via a wired channel and a wireless input unit receiving a user input via a wireless channel.

The user interface unit 380 may send, to the controller 370, the control signal input from a local key (not shown) such as a power key, a channel key, a volume key, and a setting key.

The user interface unit 380 may send, to the controller 370, a control signal input from a sensing unit (not shown) that senses a user's gesture, or send a signal of the controller 370 to the sensing unit (not shown). The sensing unit (not shown) may include a touch sensor, an audio sensor, a location sensor, a motion sensor, etc.

The controller 370 may de-multiplex a stream input through the tuner 311, the demodulator 312, or the external device interface unit 320 or process the de-multiplexed signals to generate and output a signal for video or audio output.

The controller 370 transmits pixel data of an image to the display 200 through the above-described image processing unit 100. An image signal processed by the controller 370 may be sent to an external output device through the external device interface unit 320.

The controller 370 may control the overall operation of the display device. For example, the controller 370 may control the tuner 311 to tune an RF broadcast corresponding to a channel selected by a user or a pre-stored channel.

The controller 370 may control the display device by a user command input through the user interface unit 380 or an internal program. In particular, the controller 370 can access the network and allow an application or an application list that the user wants to be downloaded to the display device.

The controller 370 may control the tuner 311 in order to input a signal of a channel selected according to a predetermined channel selection command received through the user interface unit 380. The controller 370 may process video, audio, or data signal of the selected channel. The controller 370 may output channel information, etc. selected by the user together with the processed video or audio signal through the display 200 or the audio output unit 250.

Based on an external device video playback command received through the user interface unit 380, the controller 370 may allow a video signal or an audio signal that is input from an external device, for example, a camera or a camcorder through the external device interface unit 320, to be output through the display 200 or the audio output unit 250.

The controller 370 may control the display 200 to display an image. For example, the controller 370 may control the display 200 to display a broadcast image input through the tuner 311, an external input image input through the external device interface unit 320, an image input through the network interface unit 313, or an image stored in the memory 330. In this instance, an image displayed on the display 200 may be a still image or a video, and may be a 2D video or a 3D video.

The controller 370 may control the display device to play contents. The contents may be contents stored in the display device, received broadcast contents, or external input contents input from the outside. The contents may be at least one of a broadcast video, an external input video, an audio file, a still image, an accessed web screen, and a document file.

When the controller 370 enters an application view item, the controller 370 may be configured to display an application or an applications list that is located in the display device or that can be downloaded from an external network.

The controller 370 may be configured to install and operate an application downloaded from an external network together with various user interfaces. The controller 370 may control an image related to an application to be executed to be displayed on the display 200 by a user's selection.

The display 200 converts the video signal, the data signal, an OSD signal, etc. processed by the controller 370 or the video signal, the data signal, etc. received from the external device interface unit 320 into R, G, and B signals to generate a drive signal. The display 200 may include a touch screen.

The audio output unit 350 receives a signal processed by the controller 370, for example, a stereo signal, 3.1 channel signal, or 5.1 channel signal, and outputs it as audio. The audio output unit 350 may be implemented as various types of speakers.

The display device may further include a sensing unit (not shown) including at least one of a touch sensor, an audio sensor, a location sensor, and a motion sensor in order to sense a user's gesture. The signal sensed by the sensing unit (not shown) may be sent to the controller 370 through the user interface unit 380.

The display device may further include a photographing unit (not shown) for photographing a user. Image information photographed by the photographing unit (not shown) may be input to the controller 370. The controller 370 may detect a user's gesture by individually or in combination with the image photographed by the photographing unit (not shown) or the signal sensed by the sensing unit (not shown).

The power supply unit 360 may supply power to the overall display device. The power supply unit 190 may a converter (not shown) converting AC power into DC power.

Referring to FIG. 18, the controller 370 may include a demultiplexing unit 371, a first image processing unit 372, an on-screen display (OSD) generator 373, a second image processing unit 100, a mixer 374, a frame rate converter (FRC) 375, and a formatter 376. In addition, although not shown, the controller 370 may further include an audio processing unit and a data processing unit.

The demultiplexing unit 371 demultiplexes an input stream. For example, the demultiplexing unit 371 may demultiplex input MPEG-2 TS into video, audio, and data signals. The stream signal input to the demultiplexing unit 371 may be a stream signal output from a tuner, a demodulator, or an external device interface unit.

The first image processing unit 372 performs the processing of the demultiplexed video signal. To this end, the first image processing unit 372 may include a video decoder 372*a* and a scaler 372*b*. The video signal decoded by the first image processing unit 372 may be input to the mixer 374.

The video decoder 372*a* decodes the demultiplexed video signal. The scaler 372*b* scales a resolution of the decoded video signal so that the resolution can be output on the display 200. Because the overscan generator 102 of the second image processing unit 100 performs a scaler function, the first and second image processing units can share one scaler 372*b*.

The video decoder 372*a* may support various standards. For example, the video decoder 372*a* may perform a function of the MPEG-2 decoder when the video signal is encoded in the MPEG-2 standard, and may perform a function of the H.264 decoder when the video signal is encoded in a digital multimedia broadcasting (DMB) method or the H.264 standard. The video signal output from the video decoder 372*a* may be converted into a video, in which a fixed pattern 201 moves every predetermined time, through the second image processing unit 100, and then may be supplied to the mixer 374.

The OSD generator 373 generates OSD data according to a user input or by itself. The OSD generator 155 generates data for displaying various data on a screen of the display 200 in a graphic or text form based on a control signal of the user interface unit 380. The generated OSD data includes various data such as a user interface screen (e.g., GUI) of the display device, various menu screens, widgets, icons, and viewing rate information. The OSD generator 374 may generate data for displaying subtitles of broadcast video or broadcast information based on EPG.

The mixer 374 mixes the OSD data generated by the OSD generator 155 and the video signal output from the second image processing unit 100 and provides it the formatter 376. By mixing the decoded video signal and the OSD data, the OSD is overlaid and displayed on a broadcast video or an external input video.

The frame rate converter 375 converts a frame rate of an input video. For example, the frame rate converter 375 may convert a 60 Hz video frame rate into a frame rate of, for example, 120 Hz or 240 Hz depending on an output frequency of the display 200. As described above, there may various methods for converting the frame rate. For example, when the frame rate converter 375 converts the frame rate from 60 Hz to 120 Hz, the frame rate converter 375 may convert the frame rate by inserting the same first frame between a first frame and a second frame, or inserting a third frame predicted from the first frame and the second frame between the first frame and the second frame. As another example, when the frame rate converter 375 converts the frame rate from 60 Hz to 240 Hz, the frame rate converter 375 may convert the frame rate by inserting three identical frames or three predicted frames between existing frames. If a separate frame conversion is not performed, the frame rate converter 375 may be bypassed.

The formatter 376 changes an output of the frame rate converter 375 to match an input signal format of the display 200. For example, the formatter 376 may output R, G, and B data signals, and these R, G, and B data signals may be output as a low voltage differential signal (LVDS) or a mini-LVDS. Further, when the output of the frame rate converter 375 is a 3D video signal, the formatter 376 may support 3D service through the display 200 by configuring and outputting it in a 3D format suitable for the input signal format of the display 200.

An audio processing unit (not shown) in the controller 370 may perform audio processing of a demultiplexed audio signal. The audio processing unit (not shown) may support various audio formats. For example, even if an audio signal is encoded in formats such as MPEG-2, MPEG-4, AAC, HE-AAC, AC-3, and BSAC, the audio processing unit may include a decoder corresponding thereto. The audio processing unit (not shown) may process base, treble, volume control, and the like.

A data processing unit (not shown) in the controller 370 may perform data processing of a demultiplexed data signal. For example, the data processing unit may decode the demultiplexed data signal even if the demultiplexed data signal is encoded. The encoded data signal may be EPG information including broadcast information such as a start time and an end time of a broadcast program broadcasted on each broadcast channel.

Although the embodiments have been described with reference to a number of illustrative embodiments thereof, numerous other modifications and various may be devised by those skilled in the art that will fall within the scope of the principles of the present disclosure. Accordingly, the technical range of the present disclosure should not be construed as limiting to the detailed description and should be determined by construing of the appended claims.

The invention claimed is:

1. A display device comprising:

an image processing unit configured to generate a second image by enlarging a first image with a predetermined resolution and generate a third image by selecting a portion of the second image; and a display panel configured to display the third image received from the image processing unit, wherein the image processing unit is further configured to select, as the third image, a predetermined cropping area in the second image, and wherein the image processing unit is further configured to change a location of the cropping area when a predetermined time elapses, and move the third image in the second image.

2. The display device of claim 1, wherein a resolution of the second image is greater than a screen resolution of the display panel, wherein a resolution of the third image is less than a screen resolution of the second image.

3. The display device of claim 1, wherein the image processing unit is further configured to detect a fixed pattern in the first image, wherein when the fixed pattern is detected, the image processing unit is further configured to generate the second and third images and transmit pixel data of the third image to a display panel driver for driving the display panel.

4. The display device of claim 3, wherein the image processing unit is further configured to reduce a luminance of the fixed pattern by a predetermined luminance.

5. The display device of claim 3, wherein when the fixed pattern is not detected in the first image, the image processing unit is further configured to convert the resolution of the first image into a screen resolution of the display panel and transmit pixel data of the first image to the display panel driver for driving the display panel.

6. The display device of claim 1, wherein pixel data of the third image or pixel data of the first image with a screen resolution of the display panel is transmitted using the image processing unit.

7. An image processing method of a display device, the image processing method comprising:

enlarging a first image with a predetermined resolution to generate a second image;

selecting a portion of the second image to generate a third image; and displaying the third image on a screen of a display panel, wherein selecting the portion of the second image to generate the second image comprises:

selecting, as the third image, a predetermined cropping area in the second image; and changing a location of the cropping area when a predetermined time elapses, and moving the third image in the second image.

8. The image processing method of claim 7, wherein a resolution of the second image is greater than a screen resolution of a display, wherein a resolution of the third image is less than a screen resolution of the second image.

9. The image processing method of claim 7, further comprising:

detecting a fixed pattern in the first image; and when the fixed pattern is detected, generating the second and third images and transmitting pixel data of the third image to a display panel driver for driving the display panel.

10. The image processing method of claim 9, further comprising reducing a luminance of the fixed pattern by a predetermined luminance.

11. The image processing method of claim 9, further comprising, when the fixed pattern is not detected in the first image, converting the resolution of the first image into a screen resolution of the display panel and transmitting pixel data of the first image to the display panel driver for driving the display panel.

* * * * *